US010152023B2

(12) United States Patent
Seto

(10) Patent No.: US 10,152,023 B2
(45) Date of Patent: Dec. 11, 2018

(54) IMAGE FORMING APPARATUS

(71) Applicant: CANON KABUSHIKI KAISHA, Tokyo (JP)

(72) Inventor: Masaki Seto, Gotemba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/219,421

(22) Filed: Jul. 26, 2016

(65) Prior Publication Data

US 2017/0031312 A1 Feb. 2, 2017

(30) Foreign Application Priority Data

Jul. 31, 2015 (JP) ..... 2015-152147

(51) Int. Cl.
*G03G 21/16* (2006.01)
*G03G 21/18* (2006.01)

(52) U.S. Cl.
CPC ..... *G03G 21/1842* (2013.01)

(58) Field of Classification Search
CPC combination set(s) only.
See application file for complete search history.

(56) References Cited

U.S. PATENT DOCUMENTS 8,135,305 B2 * 3/2012 Kotsuka ..... G03G 21/1647 399/111

FOREIGN PATENT DOCUMENTS

JP 4883818 B2 2/2012

* cited by examiner

*Primary Examiner* — Minh Q Phan
(74) *Attorney, Agent, or Firm* — Canon U.S.A., Inc. IP Division

(57) ABSTRACT

An image forming apparatus in which a process cartridge including a recess is configured in a detachable manner inside an apparatus main body, the image forming apparatus including, a guiding member guiding the process cartridge into the apparatus main body in a longitudinal direction, the guiding member moving up and down together with the process cartridge moving the process cartridge to an image forming position, and a lock member moving in a lifting and lowering direction intersecting a mounting direction of the process cartridge by interlocking with an up and down movement of the guiding member, in which the lock member moves in the lifting and lowering direction by interlocking with the upward movement of the guiding member, and the movement of the process cartridge in the longitudinal direction is restricted by the lock member engaging with the recess of the process cartridge.

10 Claims, 9 Drawing Sheets

IMAGE FORMING APPARATUS

BACKGROUND OF THE INVENTION

Field of the Invention

The present disclosure relates to an image forming apparatus in which a process cartridge is mounted.

Description of the Related Art

In an electrophotographic image forming apparatus (hereinafter, image forming apparatus), a process cartridge system in which an electrophotographic photosensitive drum and a process member are formed into a cartridge in an integrated manner enables a user to perform maintenance without the need of a service person. Accordingly, operability is improved. Therefore, process cartridge systems are used widely in image forming apparatuses.

Furthermore, in the process cartridge system, a configuration is proposed in which a biasing member is provided in the guide rail mounting the process cartridge, the guide rail is moved up and down to move the process cartridge up and down so as to position the cartridge in the main frame (Japanese Patent No. 4883818). In the above configuration, the operation of moving the process cartridge up and down is interlocked with the opening and closing operation of a door that is accessed to mount the process cartridge. As illustrated in FIG. 9A, by opening a link lever 90 that interlocks with the door, the guide rail 29 moves down, and in this state, the process cartridge 7 is capable of being inserted and detached in the main scanning direction. When the process cartridge 7 is mounted, the process cartridge 7 is inserted to the far side of the main body frame. Subsequently, as illustrated in FIG. 9B, when the user closes the door and the link lever 90 is pivoted, the guide rail 29 is moved up and, at the same time, the process cartridge 7 is moved up as well. In the above case, an abutment portion 45 of the process cartridge 7 is abutted against an abutment portion 38*a* of the main body frame and, further, the guide rail 29 moves up and applies biasing force to the process cartridge 7. In so doing, a configuration is discussed in which a lock member (not shown) is fixed to and disposed on a far-side frame portion 38 of the main body frame, and a hook-shaped portion (not shown) is provided in the process cartridge so that the lock member engages with the hook-shaped portion when the process cartridge 7 is moved up.

Engagement between the hook-shaped portion of the process cartridge 7 and the lock member accompanying the main body frame enables the locking of the process cartridge to be achieved with a simple configuration.

SUMMARY OF THE INVENTION

However, in the configuration described above, when the apparatus main body including the process cartridge receives a strong impact force and a vibration during physical distribution, such as transportation, the process cartridge may disadvantageously jut out upstream in the mounting direction.

Specifically, when the process cartridge receives a strong impact load in an arrow A direction illustrated in FIG. 8B, due to bending of the guide rail and due to the process cartridge pushing back the elastic force of the biasing member, the position of the process cartridge may be lowered disadvantageously. In such a case, a hook engagement portion of the process cartridge may disadvantageously come off from the lock member and the process cartridge may disadvantageously jut out in the longitudinal direction.

The present disclosure provides an image forming apparatus that prevents, in a better manner, the process cartridge from jutting out when receiving an impact and vibration.

The disclosure according to the present application is related to an image forming apparatus in which a process cartridge including a recess is configured in a detachable manner inside an apparatus main body. The image forming apparatus includes a guiding member that guides the process cartridge into the apparatus main body in a longitudinal direction, the guiding member moving up and down together with the process cartridge being capable of moving the process cartridge to an image forming position, and a lock member that is capable of moving in a lifting and lowering direction that intersects a mounting direction of the process cartridge by interlocking with an up and down movement of the guiding member. Furthermore, the lock member moves in the lifting and lowering direction by interlocking with the upwards movement of the guiding member moving in the one of the lifting and lowering direction, and the movement of the process cartridge in the longitudinal direction is restricted by the lock member engaging with the recess of the process cartridge.

Further features of the present invention will become apparent from the following description of exemplary embodiments (with reference to the attached drawings).

DESCRIPTION OF THE EMBODIMENTS

First Exemplary Embodiment

Figure 1:
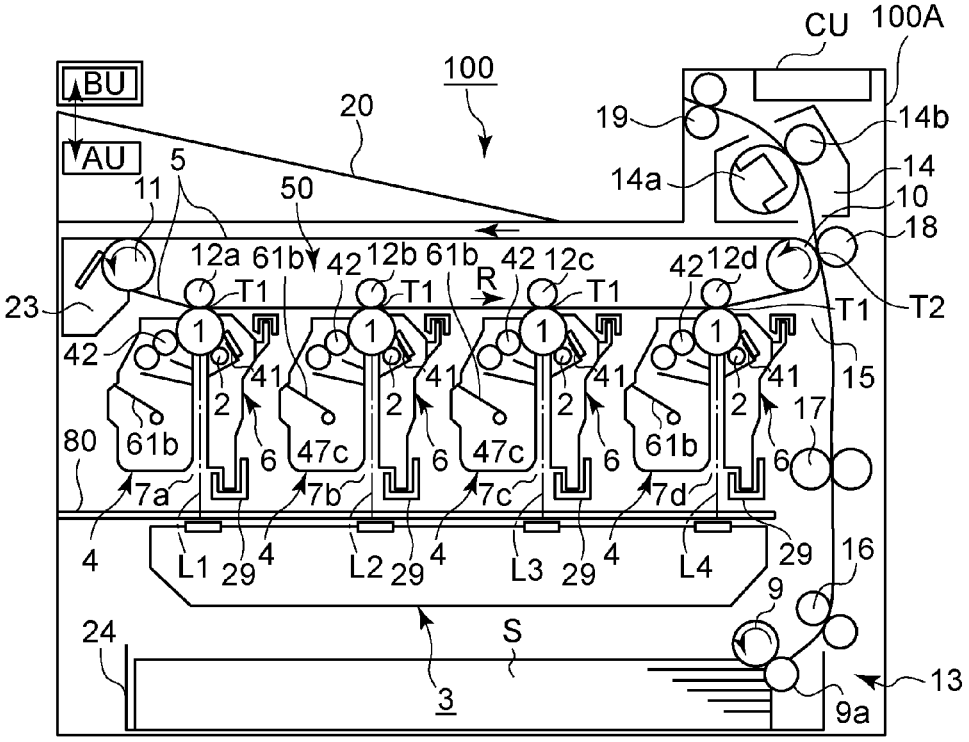
FIG. 1 is a cross-sectional view of an image forming apparatus according to a first exemplary embodiment of the present disclosure.
Figure 2A:
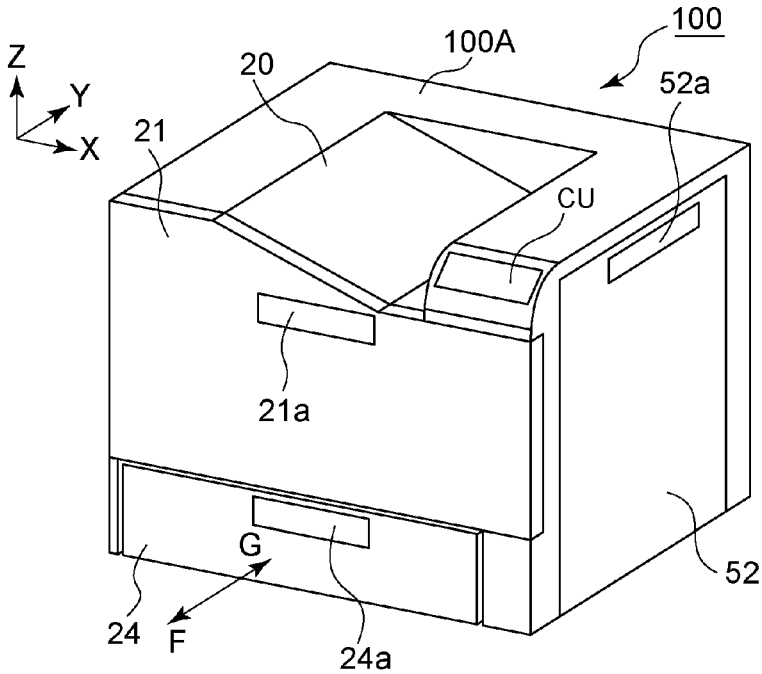
FIGS. 2A and 2B are perspective views of an external appearance of the image forming apparatus according to the first exemplary embodiment of the present disclosure.
Figure 2B:
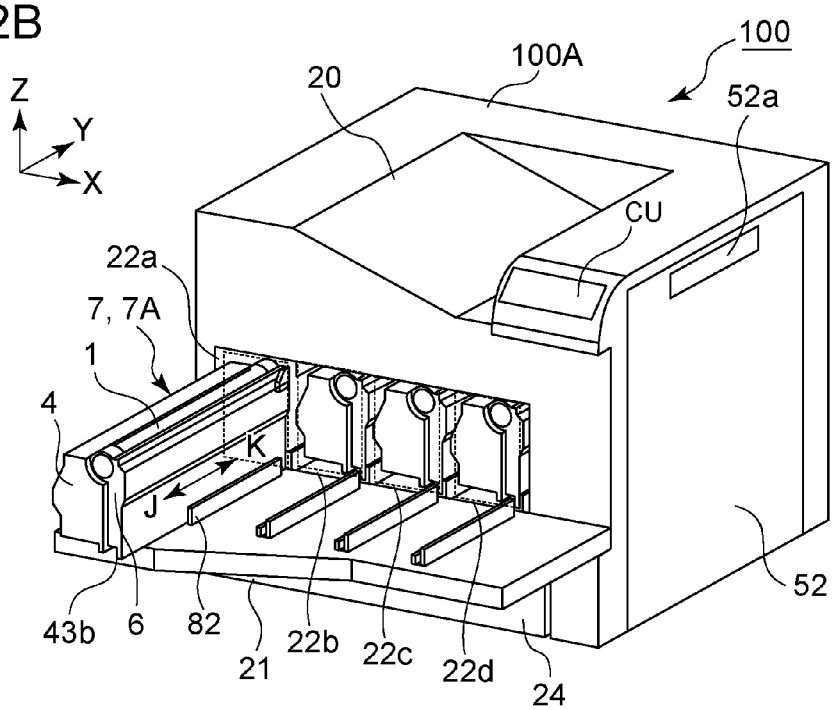

FIG. 1 is a schematic cross-sectional view of an image forming apparatus 100 according to the present exemplary embodiment and illustrates an operational state of the image forming apparatus 100 forming an image. FIGS. 2A and 2B are perspective views of an external appearance of the image forming apparatus 100. FIG. 2A is the perspective view of the external appearance of the image forming apparatus 100 in which an openable front door 21 is closed. FIG. 2B is the perspective view of the external appearance of the image forming apparatus 100 in which the front door 21 is open and illustrates a state in which the process cartridges 7 (hereinafter, cartridges) can be inserted into or drawn out from an apparatus main body 100A.

The image forming apparatus 100 of the present exemplary embodiment is a four full-color laser beam printer (a color image forming apparatus) employing an electrophotographic process. In other words, an image is formed on a sheet-shaped recording medium S (a sheet of paper, an OHP sheet, a label, or the like) on the basis of an electric image signal input to a control circuit unit (a control member such as a CPU) from an external host device BU, such as a personal computer and an image reader. The control circuit unit AU exchanges various pieces of electrical information with the external host device BU and a control unit CU and, further, integrally controls an image forming operation of the image forming apparatus 100 in accordance with a predetermined control program and a reference table.

The image forming apparatus 100 is a system in which four first to fourth cartridges 7 (7*a* to 7*d*) are detachable with respect to the apparatus main body 100A. By opening the door 21 of the apparatus main body 100A in a manner illustrated in FIG. 2B and open a front side of the apparatus main body 100A, the cartridges 7 will each become independently detachable with respect to the cartridge mount portions 22 (22*a* to 22*d*) inside the apparatus main body. The front door 21 (a door) that covers the opening for detaching the cartridges 7 is provided in the apparatus main body 100A, and a handle 21*a* is provided in the door 21. Each cartridge 7, a longitudinal direction of which being a front-rear direction, can be inserted into the corresponding cartridge mount portion 22 in the front-rear direction. Interlocking with a closing motion of the door 21, the cartridges 7 are moved to a state in which an image can be formed.

As illustrated in FIG. 1, the cartridges 7 each have a similar electrophotographic process mechanism. Each cartridge 7 of the present exemplary embodiment includes a drum 1, a charge roller (a charge member) 2 serving as a process member that acts on the drum 1, a development unit (a development member) 4, and a photosensitive unit 6. In the image forming apparatus 100 of the present exemplary embodiment, a yellow (Y) developing agent (hereinafter, referred to as toner) is stored in a toner storage chamber of a development unit 4 of the first cartridge 7*a*. A magenta (M) developing agent is stored in a toner storage chamber of a development unit 4 of the second cartridge 7*b*. A cyan (C) developing agent is stored in a toner storage chamber of a development unit 4 of the third cartridge 7*c*. A black (K) developing agent is stored in a toner storage chamber of a development unit 4 of the fourth cartridge 7*d*.

Rotational driving force is transmitted from the apparatus main body 100A side to each cartridge 7 that is mounted at a position in which an image can be formed such that each drum 1 is rotationally driven clockwise at a predetermined rate. Furthermore, a predetermined bias (a charging bias, a developing bias, and the like) is applied to each cartridge 7 from the apparatus main body 100A side.

In the apparatus main body 100A, a laser scanner unit 3 serving as a member that exposes image information on the drums 1 of the cartridges 7 is provided below the cartridge mount portions 22.

Furthermore, in the apparatus main body 100A, an intermediate transfer belt unit 50 is provided above the cartridge mount portions 22. The unit 50 includes a drive roller 10 disposed on the right side, a tension roller 11 disposed on the left side, and an endless intermediate transfer belt (hereinafter, a belt) 5 that is stretched across the rollers. Upper surface portions of the drums 1 of the cartridges 7 mounted at positions in which an image can be formed are in contact with the underside of the belt 5. The above contact portions are primary transfer portions T1. Furthermore, four first to fourth primary transfer rollers 12 (12*a* to 12*d*) that face the drums 1 of the cartridges 7 with the belt 5 in between are disposed parallel to each other inside the endless belt 5 such that rotational axis directions of the primary transfer rollers 12 extend in the front-rear direction. The belt 5 is turned counterclockwise in an arrow R direction at a speed corresponding to the rotation speed of the drum 1 with the drive roller 10 while the descending side belt portion is in contact with the upper surface portions of the drums 1 of the cartridges 7. A predetermined primary transfer bias is applied to each of the primary transfer rollers 12 at a predetermined control timing. A secondary transfer roller 18 is disposed at a position that faces the drive roller 10 with the belt 5 in between. A contact portion between the belt 5 and the secondary transfer roller 18 is a secondary transfer portion 12. A predetermined secondary transfer bias is applied to the secondary transfer roller 18 at a predetermined control timing. A transfer belt cleaning device 23 in contact with the belt 5 is disposed at a position facing the tension roller 11.

A recording medium feed device 13 is disposed in the lower portion of the apparatus main body 100A. The recording medium feed device 13 includes a feeding cassette 24 in which a recording medium (a transfer material) S is stored, a roller pair including a feed roller 9 and a retard roller 9*a*, and a conveyance roller pair 16. Furthermore, recording medium conveyance members are provided in the right side of the apparatus main body 100A from the recording medium feed device 13 to the upper portion of the apparatus main body 100A. The recording medium conveyance members include a registration roller pair 17, a conveyance path 15, the secondary transfer portion 12, a fixing unit (a fixing member) 14, and a discharge roller pair 19. An upper surface of the apparatus main body 100A is a discharge tray 20.

The feeding cassette 24 is configured so as to be capable of being drawn in and out from the front side (capable of being accessed from the front) of the apparatus main body 100A. A handle 24*a* is disposed in the feeding cassette 24. In other words, as illustrated by an arrow F in FIG. 2A, the feeding cassette 24 is capable of being drawn out towards an upstream (near) side of the apparatus main body 100A, and the user sets recording mediums S in the feeding cassette 24 by dismounting the feeding cassette 24 from the apparatus main body 100A. By inserting the feeding cassette 24 inside the apparatus main body 100A as illustrated by and arrow G in FIG. 2A, supplying of the recording mediums S is completed.

A right lateral side door 52 is attached to a right lateral side of the apparatus main body 100A in a pivotable manner. By pulling a handle 52*a* provided in the right lateral side door 52, the right lateral side door 52 can be pivoted and a conveyance path can be made open to the outside. With the above, in a case in which the recording medium S becomes jammed, a work space for removing the jammed recording medium S can be obtained.

Configuration of Cartridge

Description of the cartridge 7 of the present exemplary embodiment will be given with reference to FIGS. 3 and 4. The first to fourth cartridges 7 (7*a* to 7*d*) have the same configuration with respect to each other except that the color of the toner, namely, Y, M, C, and K, stored inside the toner storing chambers of the development units 4 are different.

Figure 3:
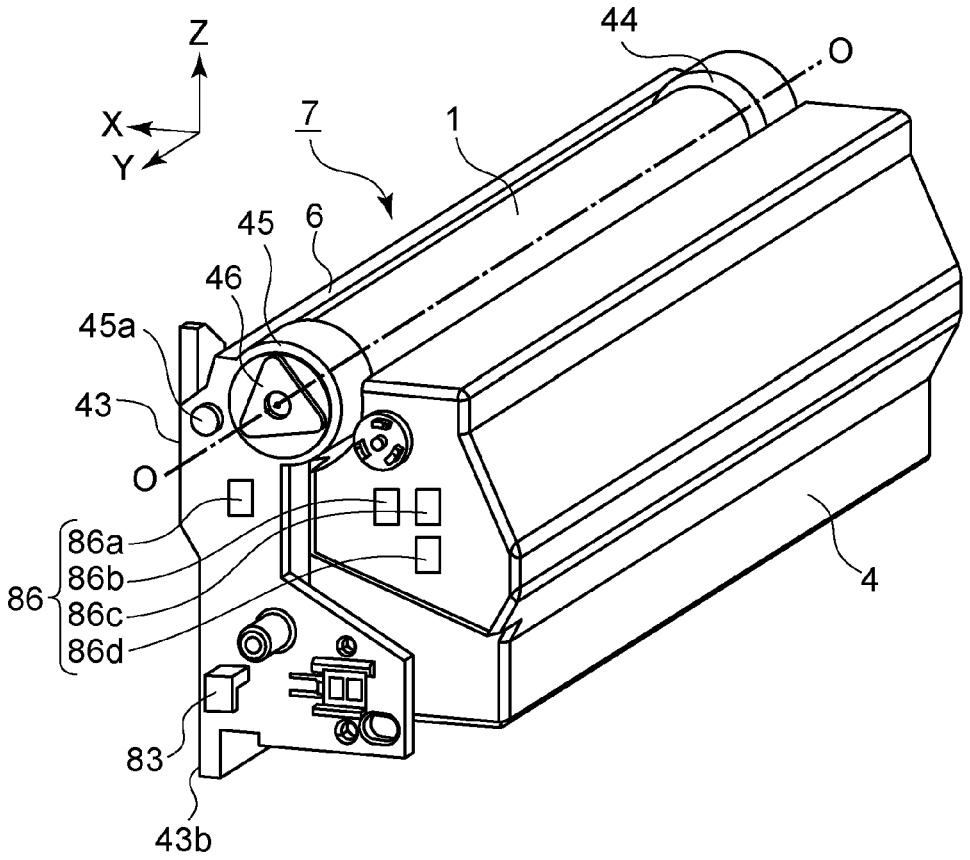
FIG. 3 is a perspective view of a process cartridge that is mounted in the image forming apparatus according to the first exemplary embodiment of the present disclosure.
Figure 4:
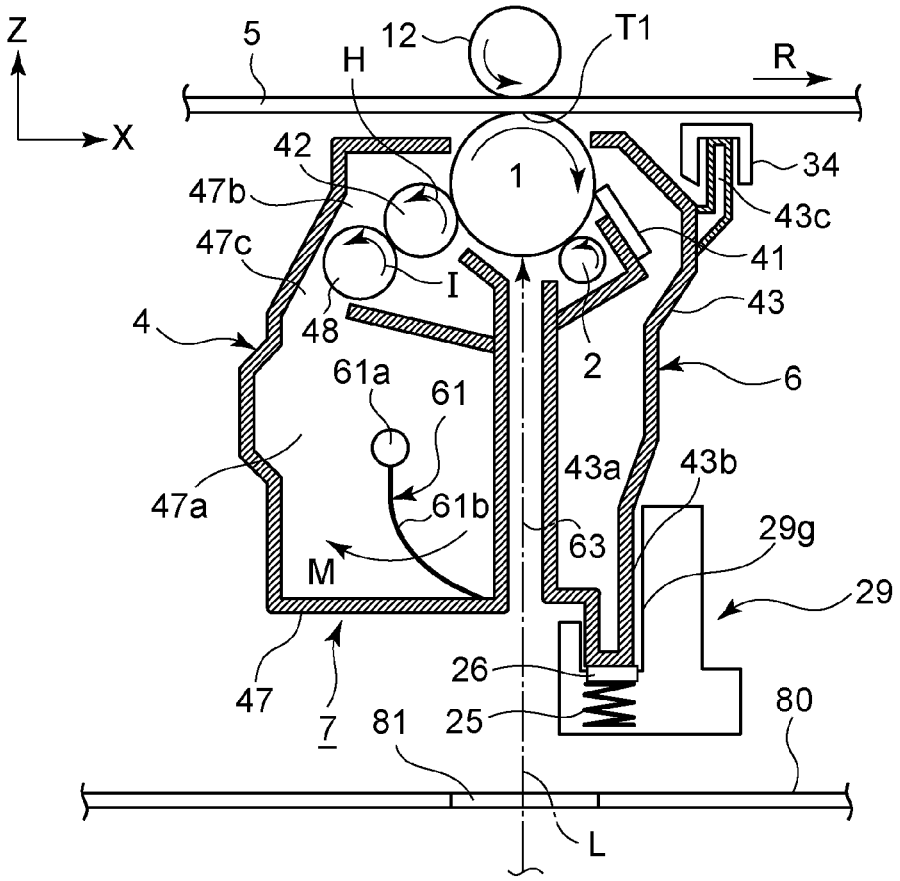
FIG. 4 is a cross-sectional view of a vicinity of the process cartridge and illustrates the process cartridge and the apparatus main body according to the first exemplary embodiment of the present disclosure.

FIG. 3 is a perspective view of an external appearance of the cartridge 7 viewed from the downstream side (the drive side) in the mounting direction. FIG. 4 is a cross-sectional view illustrating the cartridge 7 and the surrounding portion of the cartridge 7 that is mounted inside the apparatus main body 100A at a position in which an image can be formed.

The cartridge 7 is an assembly in which the length of the cartridge 7 extends in a rotational axis direction O-O (FIG. 3) of the drum 1. The cartridge 7 includes a photosensitive unit 6 including the drum 1, a charge roller 2, and a cleaning member 41, and a development unit 4 including a development roller 42 serving as a developing agent-bearing member (development member).

The drum 1 is rotatably attached to a cleaning frame body 43 of the photosensitive unit 6 through bearing members 44 and 45 on the upstream side and the downstream (far) side. The charge roller 2 and the cleaning member 41 are disposed on the drum 1. The charge roller 2 is maintained in contact with the drum 1 at a predetermined pressing force and is rotated by following the rotation of the drum 1. The cleaning member 41 is maintained in contact with the drum 1 at a predetermined pressing force. Residual toner removed from the surface of the drum 1 with the cleaning member 41 drops into a removed toner chamber 43*a* constituted by the cleaning frame body 43. A drive input coupling (a drive receiving portion) 46 is provided at an end portion of the cleaning frame body 43 on the downstream (far) side when viewed in the cartridge mounting direction.

A toner storage chamber (developer storage portion) 47*a* that stores toner serving as a developing agent, and a development chamber 47*b* in which a development roller 42 that rotates in an arrow H direction by being in contact with the drum 1 are provided in a development frame body 47 of the development unit 4. The development chamber 47*b* is disposed above the toner storage chamber 47*a*, and the toner storage chamber 47*a* and the development chamber 47*b* are in communication with each other through an opening portion 47*c* positioned above the toner storage chamber 47*a*. A toner feed roller 48 serving as a developer feed member that rotates in an arrow I direction by being in contact with the development roller 42 is disposed on the circumference of the development roller 42.

A rotatably supported toner stirring member 61 that stirs the stored toner and that sends the toner to the toner feed roller 48 in the development chamber 47*b* through the opening portion 47*c* is provided in the toner storage chamber 47*a*. The toner stirring member 61 includes a shaft member 61*a*, and a flexible resin stirring sheet 61*b*, one end of which is attached to the shaft member 61*a*, for stirring and conveying the toner. The toner stirring member 61 is rotationally driven at a predetermined rate in an arrow M direction according to the image forming operation.

The development frame body 47 of the development unit 4 is joined to the cleaning frame body 43 of the photosensitive unit 6 in an integrated manner.

A guide rib pattern 43*b* is formed in the lower portion of the cleaning frame body 43 along the length of the cleaning frame body 43. The guide rib pattern 43*b* engages with a guide groove portion 82 (FIG. 2B) of the front door 21. A gap between the photosensitive unit 6 and the development unit 4 is a slit opening portion 63 (FIG. 4) serving as a laser beam incident opening portion.

The primary transfer portion T1 is formed when the upper surface of the drum 1 faces the primary transfer roller 12 and is in contact with the underside of the belt 5 while in a state in which the cartridge 7 inserted along the cartridge mount portion 22 of the apparatus main body 100A is positioned at a mounting position in which image formation can be performed. Furthermore, a drive output coupling (a drive output portion, not shown) on the apparatus main body 100A side is joined to the drive input coupling 46. By transmitting driving power from the drive output coupling to the drive input coupling 46, each of the drum 1, the development roller 42, the toner feed roller 48, and the toner stirring member 61 is rotationally driven in a predetermined rotation direction at a predetermined rate. Furthermore, as illustrated in FIG. 3, an electrical input contact 86 (86*a*, 86*b*, 86*c*, or 86*d*) is disposed on a lateral side of the cartridge 7. An electrical output contact (not shown) is electrically disposed on the apparatus main body 100A side so as to be connected to the electrical input contact 86. By applying a predetermined bias to the electrical input contact 86 from the electrical output contact, a predetermined charging bias and a predetermined developing bias are applied to the charge roller 2 and the development roller 42 according to the image forming operation. Furthermore, as illustrated in FIG. 4, a position of the slit opening portion 63 serving as the laser beam incident opening portion corresponds to a position of the laser beam irradiation window portion 81 (81*a* to 81*d*) that is provided in a top plate 80 of the laser scanner unit 3. A laser beam L (L1 to L4) output from the laser scanner unit 3 irradiates the underside of the drum 1 while entering the cartridge 7 through the slit opening portion 63 at the lower side.

Furthermore, a hook-shaped portion 83 (a recess) described later is provided in the lateral side portion of the cartridge 7 in an integrated manner. A state in which the cartridge 7 is engaged with the apparatus main body 100A will be described later.

Full Color Image Forming Operation

An operation of forming a color image is performed in the following manner. On a basis of a print start signal, the control circuit unit AU starts an image forming operation of the image forming apparatus 100. In other words, in accordance with the image forming timing, the drum 1 of each of the first to fourth cartridges 7 (7*a* to 7*d*) is rotationally driven clockwise in the arrow direction at a predetermined rate. The belt 5 is rotationally driven counterclockwise (a forward direction with respect to the rotation of the drums 1) in the arrow R direction at a rate that corresponds to the rate of the drums 1. The laser scanner unit 3 is also driven. Synchronizing with the above drive, the surface of the drum 1 in each cartridge 7 is uniformly charged so as to have a predetermined polarity and potential with the corresponding charge roller 2 to which a predetermined charging bias has been applied. The laser scanner unit 3 scans and exposes laser beams L (L1 to L4) that have each been modulated according to an image information signal of the corresponding one of the colors, namely, Y, M, C, and K, on the surface of the corresponding drum 1. Each laser beam L is emitted upwards from a corresponding one of first to fourth window portions 81 (81*a* to 81*d*) provided in the top plate 80 of the scanner unit 3 (see FIG. 4). Each laser beam L (L1 to L4) output from the laser scanner unit 3 irradiates the underside of the corresponding drum 1 while entering the corresponding cartridge 7 through the corresponding laser beam incident opening portion 63. With the above, an electrostatic latent image corresponding to the image information signal of the corresponding color is formed on the surface of the corresponding photosensitive drum 1. Each electrostatic latent image that has been formed is developed into a toner image with the development roller 42 of the corresponding development unit 4.

With the operation associated with the electrophotographic image forming process described above, a yellow toner image Iy corresponding to a yellow component of the full color image is formed on the drum 1 of the first cartridge 7*a*. The toner image Iy is primarily transferred onto the belt 5 at the primary transfer portion T1 of the cartridge 7*a*. A magenta toner image Im corresponding to a magenta component of the full color image is formed on the drum 1 of the second cartridge 7*b*. The toner image Im is primarily transferred onto the belt 5 at the primary transfer portion T1 of the cartridge 7*b* so as to be superimposed on the toner image Iy that has already been transferred to the belt 5. A cyan toner image Ic corresponding to a cyan component of the full color image is formed on the drum 1 of the third cartridge 7*c*. The toner image Ic is primarily transferred onto the belt 5 at the primary transfer portion T1 of the cartridge 7*c* so as to be superimposed on the toner images Iy and Im that have already been transferred to the belt 5. A black toner image Ib corresponding to a black component of the full color image is formed on the drum 1 of the fourth cartridge 7*d*. The toner image Ib is primarily transferred onto the belt 5 at the primary transfer portion T1 of the cartridge 7*d* so as to be superimposed on the toner images Iy, Im, and Ic that have already been transferred to the belt 5. A primary transfer bias having a predetermined potential with a polarity that is opposite the charge polarity of the toner is applied to the first to fourth primary transfer rollers 12 (12*a* to 12*d*) at a predetermined control timing.

An unfixed full color toner image of four colors, namely, yellow, magenta, cyan, and black is synthetically formed on the moving belt 5 in the above manner. The unfixed toner image conveyed by the rotation of the belt 5 reaches the secondary transfer portion T2.

In each cartridge 7, the primary-transfer remaining toner remaining on the surface of the corresponding drum 1 after primary transfer is removed and cleaned by a cleaning member 41 of the corresponding photosensitive unit 6, and the surface of the corresponding drum 1 is used in the next image forming process.

Meanwhile, a sheet of recording medium S in the feeding cassette 24 is fed out with the feed roller 9 and the retard roller 9*a* at a predetermined control timing and is conveyed to the registration roller pair 17 with the conveyance roller pair 16. The recording medium S is passed through the conveyance path 15 at a predetermined control timing with the registration roller pair 17 and is conveyed to the secondary transfer portion T2. A secondary transfer bias having a predetermined potential with a polarity that is opposite the charge polarity of the toner is applied to the secondary transfer roller 18 at a predetermined control timing. With the above, the recording medium S is conveyed to the secondary transfer portion T2, and the toner image on the belt 5 on which four colors are superimposed is secondarily transferred onto the surface of the recording medium S. The recording medium S that has exited the secondary transfer portion T2 is separated from the belt 5 and is conveyed to the fixing unit 14. Furthermore, the toner image is fixed to the recording medium S by being heated and compressed while being pinched and transported with the fixing nip portion serving as a pressure contact nip portion between a fixing member 14*a* and a pressing member 14*b* of the fixing unit 14. The recoding medium that has exited the fixing unit 14 is discharged to the discharge tray 20 with the discharge roller 19.

The secondary-transfer remaining toner remaining on the surface of the belt 5 after secondary transfer of the toner image to the recording medium S is removed from the surface of the belt 5 with the transfer belt cleaning device 23, and the surface of the cleaned belt 5 is used in the next image forming process.

The toner that has been removed by the transfer belt cleaning device 23 passes through a waste toner conveyance path (not shown) and is conveyed to and collected by a waste toner collecting container (not shown) disposed in the apparatus main body 100A.

Cartridge Replacing System

The image forming apparatus 100 of the present exemplary embodiment adopts a front access system in which the replacement of the cartridges 7 can be performed by opening the front door 21 serving as an opening and closing member provided on the front side of the apparatus main body 100A in a manner illustrated in FIG. 2B so as to enable the cartridges 7 to be moved in and out.

Figure 5A:
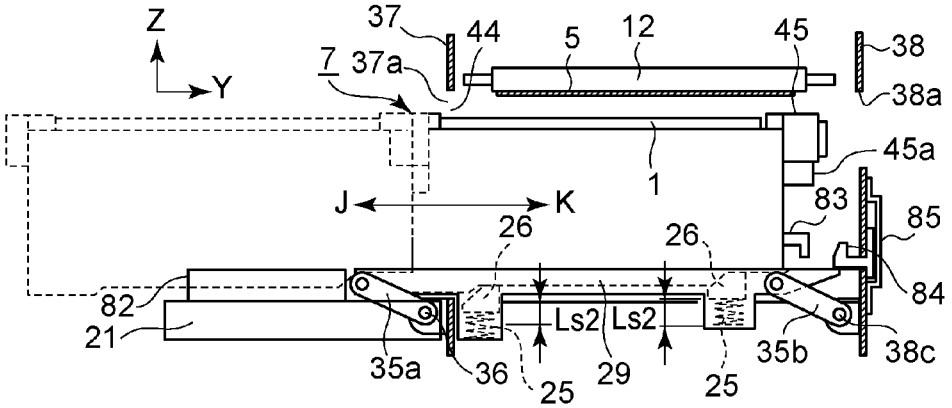
FIGS. 5A to 5C are conceptual and explanatory drawings of a mounting process of the process cartridge according to the first exemplary embodiment of the present disclosure.
Figure 5B:
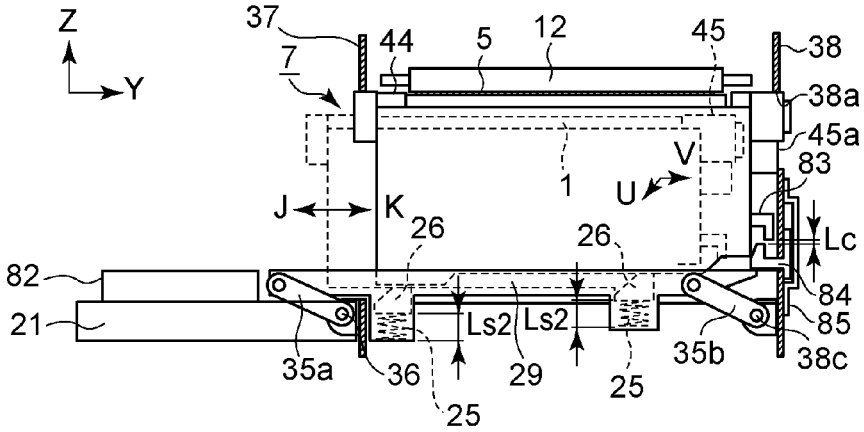
Figure 5C:
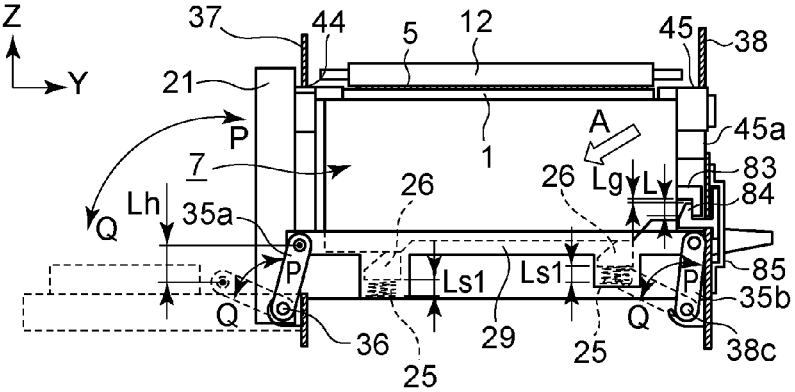

An opening portion 37*a* that passes the cartridge 7 therethrough for detaching the cartridge 7 is provided in an upstream-side frame 37 serving as a frame of the apparatus main body 100A (see FIGS. 5A to 5C). In other words, opening portions 37*a* for inserting the cartridges 7 inside the cartridge mount portions 22 in the apparatus main body 100A and for taking out the cartridges 7 from the cartridge mount portions 22 are provided. The front door 21 is disposed in the apparatus main body 100A so as to be capable of moving between a closed position in which the front door 21 covers and closes the opening portions 37*a* and an open position in which the opening portions 37*a* are open.

FIGS. 5A to 5C are drawings for explaining an operation performed when the cartridge 7 is detached from or attached to the apparatus main body 100A. FIG. 5A illustrates an operation (a detachable position) when the cartridge 7 is slid, and detached from or attached to the apparatus main body 100A. FIG. 5B illustrates a state (a lifting/lowering position) in which the cartridge 7 has been moved to a positioning position. Furthermore, FIG. 5*c* illustrates a state (an image forming position) in which, by lifting a guide rail 29 (a guiding member) with the operation of closing the front door 21, the cartridge 7 is pressed and set to a state in which image can be formed.

A cartridge replacing procedure will be described sequentially.

The state illustrated in FIG. 5C is a state of each cartridge 7 when an image is formed. As described in detail later, each hook-shaped portion 83 on a corresponding cartridge lateral side that is an end surface on the downstream side engages with a corresponding lock member 84, capable of being lifted and lowered, disposed in a downstream-side frame 38; accordingly, each cartridge 7 is locked so that each cartridge 7 cannot move downstream in an insertion direction.

From the above state, when the front door 21 is opened by being pivoted about a shaft 36 serving as a pivotal center, upstream-side pivot arms 35*a* each interlocked with the rotation of the shaft 36 rotates in a Q direction in the drawing. With the rotation of the upstream-side pivot arms 35*a* in the Q direction, downstream-side pivot arms 35*b* that are pivotably fixed to the downstream-side frame 38 are pivoted about a pivotal center 38*c* to a position illustrated in FIG. 5*b* with the guide rails 29 connected to the upstream-side pivot arms 35*a*. With the above, pressures of press members 25 to the cartridges 7 inside the apparatus main body 100A are released. At the same time, the lock members 84 described later interlocking with the lowering movements of the guide rails 29 are lowered and the engagements with the hook-shaped portions 83 of the cartridges 7 are cancelled.

Subsequently, from the state illustrated in FIG. 5B, a cartridge 7 that is to be replaced is pulled upstream in an arrow J direction. With the above, the cartridge 7 is moved, along an inclined surface of an underside of the cleaning frame body 43 and an inclined surface of pressure followers 26 disposed in the guide rail 29, from the positioning position (the positioning position in the Z-direction and Y-direction in the drawing) towards the main body upstream side in an arrow U direction and towards the lower side in the drawing.

Furthermore, from the state illustrated in FIG. 5A, the cartridge 7 is pulled upstream in the arrow J direction. Guide groove portions 29*g* (see FIG. 4) of the guide rails 29 (29*a* to 29*d*) and guide grooves (guide portions) 82 (82*a* to 82*d*) provided on the inner side of the front door 21 are provided so as to be in communication with each other. Accordingly, the cartridge 7 can be taken out external to the apparatus main body 100A by sliding the guide rib pattern 43*b* at the lower portion of the cleaning frame body 43 along the guide groove portion 29*g* (see FIG. 4) of the guide rail 29 and the guide groove 82 of the front door 21. As described above, when the front door 21 is in an open state, since the guide groove 29*g* of each guide rail 29 and the corresponding guide groove 82 disposed on the inner side of the front door 21 are in communication with each other so as to form a guide rail, the replacement operation of the user is facilitated. In the above case, a guide on the upper side of each cartridge 7 is guided by a corresponding upper side rail 34 (see FIG. 4).

Subsequently, a new cartridge 7 is inserted into the apparatus main body 100A through the opening portion, the guide rib pattern 43*b* at the lower portion of the cleaning frame body 43 is engaged with the guide groove portion 82 of the front door 21, and an upper side guide rib pattern 43*c* is guided by the upper side rail 34.

As illustrated in FIG. 5A, the cartridge 7 in communication with the guide rail 29 is moved towards the downstream side in an arrow K direction into the interior of the main body.

Subsequently, as illustrated in FIG. 5B, the user pushes the cartridge 7 further in the arrow K direction in the drawing until an abutment portion 45*a* provided in a bearing member 45 on the downstream side of the cartridge 7 abuts against the downstream-side frame 38. With the above, the cartridge 7 is moved obliquely upwards along the inclined surface of the pressure follower 26 and the cartridge 7 is pushed in until the longitudinal-direction abutment portion 45*a* of the cartridge 7 abuts against the downstream-side frame 38; accordingly, the cartridge 7 is set to the cartridge positioning position. As described above, the cartridge 7 is set to the positioning position with a trace illustrated by an arrow V in the drawing. In so doing, there is a certain amount of clearance Lc between the hook-shaped portion 83 of the cartridge 7 and the lock member 84.

Subsequently, after all of the old cartridges 7 that are to be replaced with new cartridges 7 are replaced, as illustrated in FIG. 5C, the front door 21 is closed. The closing operation of the front door 21 pivots the pivot arms 35, and a pressure against the apparatus main body 100A is applied through the cartridges 7 in the cartridge mount portions 22 inside the apparatus main body 100A such that the cartridges 7 are set to a state in which an image can be formed. In the above, the guide rails 29 are moved up and pressure is applied to the cartridges 7 with the press members 25 provided in the guide rails 29 such that the cartridges 7 are set to the positioning portions in the upstream-side frame 37 and the downstream-side frame 38 through the pressure followers 26.

The above configuration enables the user to replace the cartridges 7 with the minimum number of steps possible and with a simple operation without damaging the drums 1 and the belt 5.

Cartridge Lock Mechanism

Detailed description of a cartridge lock mechanism will be given next. As described above, an engagement and releasing operation between the hook-shaped portion 83 of each cartridge 7 that is positioned at the image forming position and the corresponding lock member 84 disposed in the downstream-side frame 38 is performed by lifting and lowering the corresponding guide rail 29.

Figure 6:
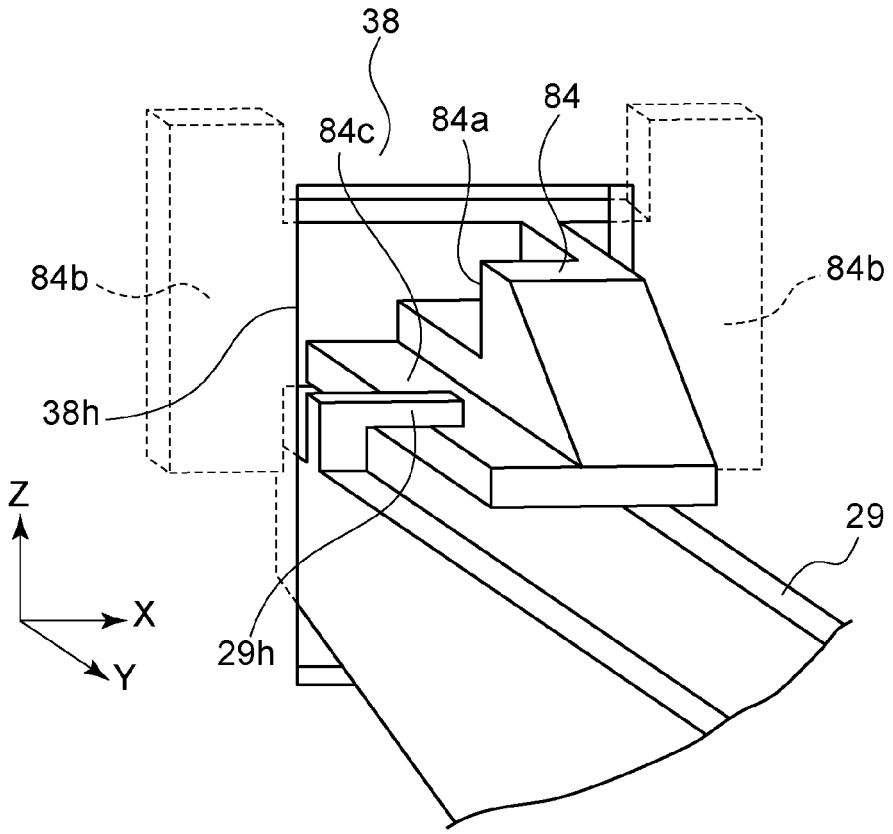
FIG. 6 is a perspective view of a process cartridge lock mechanism according to the first exemplary embodiment of the present disclosure.

FIG. 6 illustrates a perspective view of the cartridge lock mechanism. As illustrated in FIG. 6, a lock portion 84*a* of the lock member 84 is protruded through a cut-away hole 38*h* of the downstream-side frame 38 from the rear side of the apparatus main body 100A. Furthermore, a holding member 85 (see FIGS. 5A to 5C) disposed from the rear side and the downstream-side frame 38 hold a slide portion 84*b* of the lock member 84 therebetween so as to restrict movements in the cartridge mounting direction (the Y direction in FIG. 6) and the left-right direction (X direction in FIG. 6). In the above, the lock member 84 is disposed so as to be movable in a range in which the guide rail 29 can be moved up and down in the lifting and lowering direction of the guide rail 29 that intersects the mounting direction of the cartridge 7, that is, in the up-down direction (the Z direction in FIG. 6) of the apparatus main body 100A.

When the guide rail 29 is lifted up, that is, when the guide rail 29 is moved in one of the lifting and lowering direction, an upper surface of the guide rail 29 comes in contact with and lifts up a bottom surface portion of the lock member 84 such that the lock member 84 is moved up, that is, such that the lock member 84 is moved in the one of the lifting and lowering direction. Furthermore, when the guide rail 29 moves down, the arm shaped portion 29*h* provided in the guide rail 29 moves down while being engaged with a guide surface 84*c* of the lock member 84; accordingly, the lock member 84 moves down as well.

Comparative Example

Figure 8A:
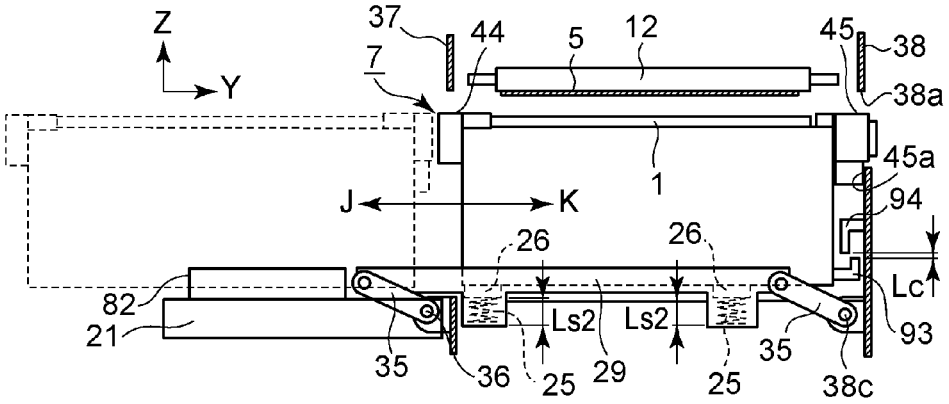
FIGS. 8A and 8B are explanatory drawings of a process cartridge mounting process of a comparative example.
Figure 8B:
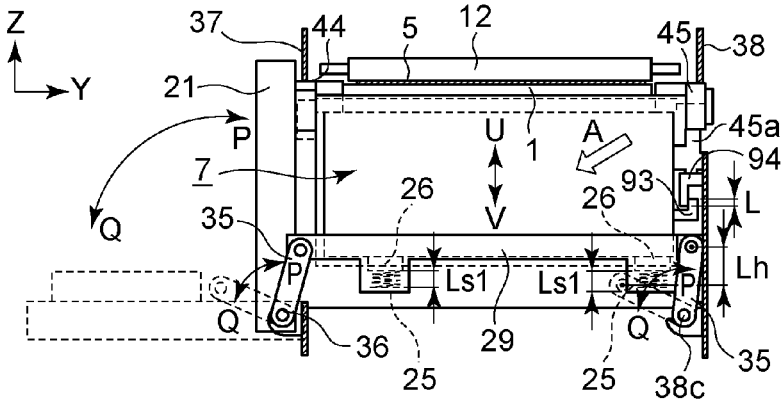
Figure 9A:
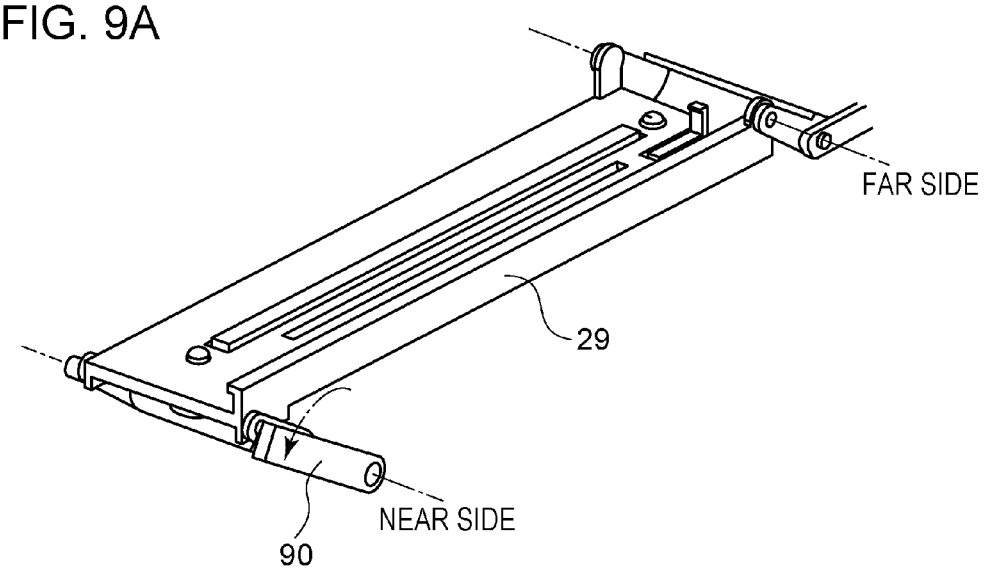
FIGS. 9A and 9B are explanatory drawings of a process cartridge mounting process of a conventional example.
Figure 9B:
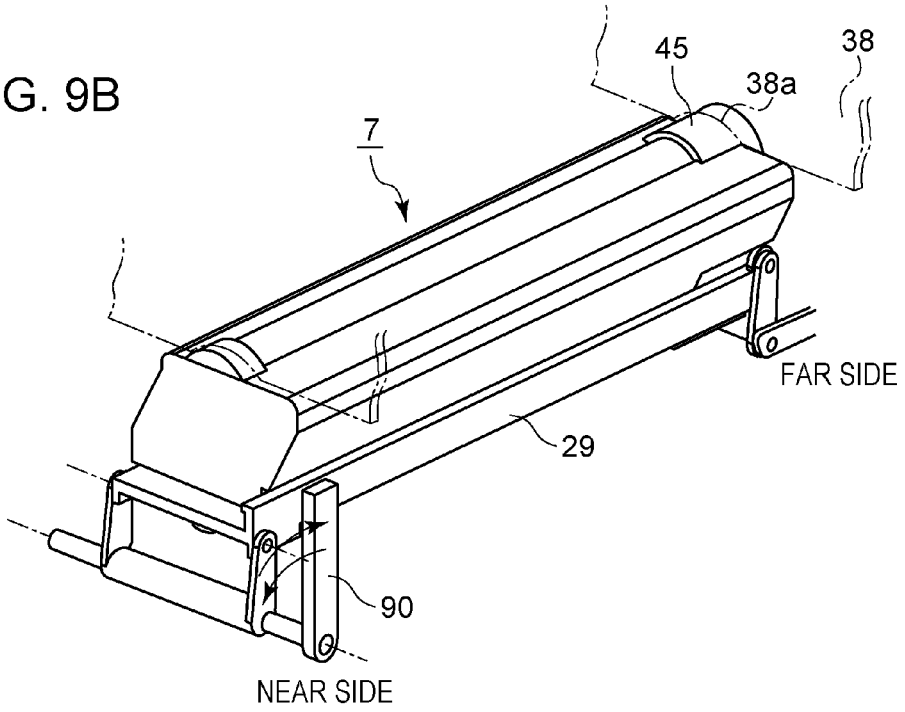

As described in the description of the related art, a configuration is discussed in which a hook-shaped portion is provided in a cartridge so that a lock member (not shown) that is fixed and disposed on a downstream-side frame 38 of a main body frame engages with the hook-shaped portion when the cartridge 7 is lifted up. However, in such a case, a lock engagement amount L that is the engagement amount between a lock member 94 and a hook-shaped portion 93 in the lifting and lowering direction (the Z direction) of the guide rail 29 illustrated in FIG. 8B may be set with the following settings. Assume that the amount of lifting and lowering movement of the guide rail 29 is Lh, and the clearance between the lock member 94 and the hook-shaped portion 93 when the cartridge 7 in the lifting/lowering position is mounted in the longitudinal direction is Lc. Furthermore, assume that the press stroke of the press members 25 (the length obtained by subtracting a spring length Ls1 of springs when the springs are pressing from a spring length Ls2 when the springs are not pressing as illustrated in FIGS. 8A and 8B) is Ls. In such a case, the lock engagement amount L is set at a length obtained by subtracting the clearance Lc and the press stroke Ls from the amount Lh of the lifting and lowering movement.

Advantageous Effect

As illustrated in FIG. 8B, in a state in which the cartridge 7 is at the positioning position in the apparatus main body and in which the guide rail is lowered, the lock member 84 interlocking with the lowering movement of the guide rail 29 moves down. Accordingly, the engagement between the lock portion 84*a* of the lock member 84 and the hook-shaped portion 83 of the cartridge 7 is in a cancelled state and the user can detach the cartridge 7. On the other hand, as illustrated in FIG. 5C, in a state in which the front door is closed and the guide rail is moved up, the lock member 84 interlocking with the guide rail 29 moves up, and the lock portion 84*a* of the lock member 84 and the hook-shaped portion 83 of the cartridge 7 are engaged with each other.

In the comparative example, there are cases in which the engagement amount L between the lock member 94 and the hook-shaped portion 93 becomes small due to loosening of the guide rail 29 or deformation of the press member 25. Conversely, in the present exemplary embodiment, decrease in the engagement amount between the lock member 84 and the hook-shaped portion 83 due to loosening of the guide rail 29 or deformation of the press member 25 can be suppressed. Specifically, a case in which the cartridge 7 receives a strong impact load in the arrow A direction in the drawing of FIG. 5C and a force countering the pressing force of the press members 25 of the guide rail 29 is applied to the cartridge 7 such that the cartridge 7 may be made to move down can be considered to occur. However, in the present exemplary embodiment, the hook-shaped portion 83 of the cartridge 7 is shaped so as to open downwards, that is, the hook-shaped portion 83 is shaped so as to open in a direction that is opposite the direction, among the lifting and lowering directions, orienting the cartridge 7 towards the position in which an image can be formed. With the above, even if the guide rail 29 loosens and, further, even if the press member 25 is deformed, a decrease in the engagement amount between the lock portion 84*a* and the hook-shaped portion 83 can be prevented. In other words, when the apparatus is physically distributed, such as being transported, while the cartridge is included in the apparatus main body, even if an impact and vibration is applied, the cartridge can be prevented from jutting out towards the upstream side in the cartridge mounting direction.

Furthermore, with the configuration described above, the engagement amount L between the lock member 84 and the hook-shaped portion 83 of the present exemplary embodiment can be smaller than the engagement amount L between the lock member 94 and the hook-shaped portion 93 of the comparative example. Specifically, in the present exemplary embodiment, disposition can be performed while being displaced by the amount obtained by subtracting the clearance Lc between the lock member 84 and the hook-shaped portion 83 when the cartridge is mounted in the longitudinal direction from the amount Lh of the lifting and lowering movement of the guide rail 29. As described above, in the present exemplary embodiment, the engagement amount L does not have to be, as in the comparative example, an amount in which the press stroke Ls that is needed to press the cartridge 7 is also subtracted and, accordingly, compared with that of the comparative example, a larger displacement of the engagement amount L can be obtained. As a result, the amount Lg of the gap between the lock member 84 and the hook-shaped portion 83 can be set smaller than the lock engagement amount L, and a configuration can be obtained in which the lock member 84 and the hook-shaped portion 83 impinges against each other before the lock is released such that the locked and engaged state does not become cancelled. Furthermore, without increasing the amount of lifting and lowering movement of the guide rail, the engagement amount L between the lock member 84 and the hook-shaped portion 83 can be sufficiently large; accordingly, increase in the size of the apparatus main body 100A can be suppressed and jutting out of the cartridge due to receiving impact can be reliably prevented.

Second Exemplary Embodiment

Figure 7A:
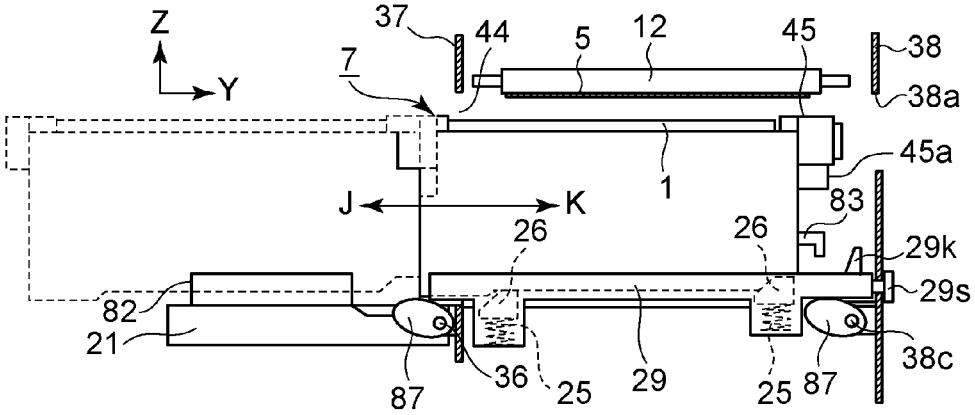
FIGS. 7A to 7C are conceptual and explanatory drawings of a mounting process of the process cartridge according to a second exemplary embodiment of the present disclosure.
Figure 7B:
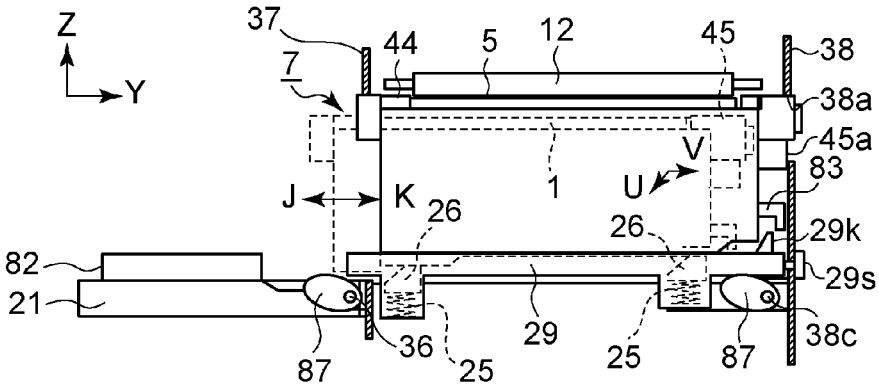
Figure 7C:
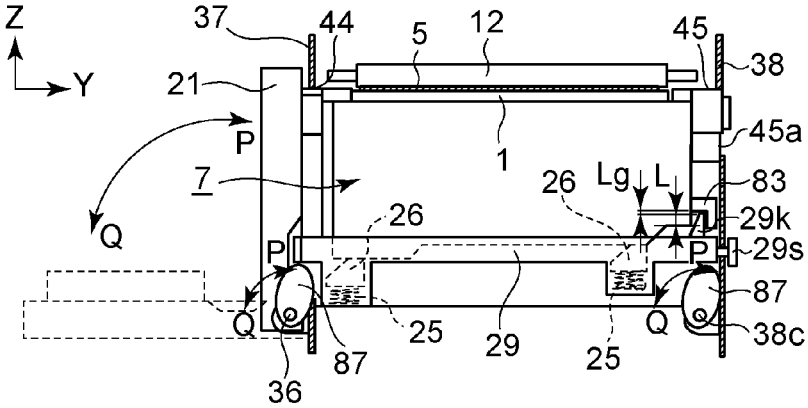

An image forming apparatus according to a second exemplary embodiment of the present disclosure will be described next with reference to FIGS. 7A to 7C. Components of the second exemplary embodiment that are the same as those of the first exemplary embodiment are attached with the same reference numerals and description thereof is omitted. FIGS. 7A to 7C illustrate a cartridge of the image forming apparatus of the second exemplary embodiment while the cartridge is being mounted, and are cross-sectional views and schematic block diagrams of the apparatus main body.

In FIG. 7A, similar to the first exemplary embodiment, the cartridge 7 in communication with the guide rail 29 is moved into the interior of the main body in a direction illustrated by the arrow K oriented downstream.

Subsequently, in FIG. 7B as well, similar to the first exemplary embodiment, the cartridge 7 further pushed in the arrow K direction in the drawing until an abutment portion 45*a* provided in the bearing member 45 on the downstream side of the cartridge 7 abuts against the downstream-side frame 38. With the above, the cartridge 7 is moved obliquely upwards along the inclined surface of the pressure follower 26 and the cartridge 7 is moved until the longitudinal-direction abutment portion 45*a* of the cartridge 7 abuts against the downstream-side frame 38. As described above, the cartridge 7 is set to the positioning position with a trace illustrated by an arrow V in the drawing.

Note that an oscillation cam 87 is disposed at a rotation center 36 of the front door 21. An oscillation cam 87 is disposed at a position near the downstream-side frame 38 of the apparatus main body 100A as well. Furthermore, the two oscillation cams 87 move the guide rail 29 in a lifting and lowering direction (the Z direction in the drawing) of the guide rail 29 that intersects the cartridge mounting direction. The two oscillation cams 87 are configured to swing at the same swinging angle while being interlocked with the pivotal movement of the front door 21 through a link member. A slide guide portion 29*s* that is capable of moving along the downstream-side frame 38 is formed so that a portion of the guide rail 29 extends over and engages with the downstream-side frame 38. Similarly, two oscillation cams and a lifted and lowered guide rail are configured in a similar form in other cartridge stations as well.

As illustrated in FIG. 7C, when the front door 21 is closed, the oscillation cams 87 interlocking with the closing operation pivot, and a pressure against the apparatus main body 100A is applied through each of the cartridges 7 in the cartridge mount portions 22 inside the apparatus main body 100A such that the cartridges 7 are set to a state in which an image can be formed. In the above, the guide rails 29 are moved up with the rotation of the oscillation cams 87 and pressure is applied to the cartridges 7 with the press members 25 provided in the guide rails 29 such that the cartridges 7 are set to the positioning portions in the upstream-side frame 37 and the downstream-side frame 38 through the pressure followers 26.

The hook-shaped portion 83 of each cartridge 7 is configured in a similar manner to that of the first exemplary embodiment. A lock portion projection 29*k* is configured together with the guide rail 29 in an integrated manner.

When in an image forming state by closing the front door 21, the guide rails 29 are moved up and the lock portion projections 29*k* integrally formed together with the guide rails 29 are moved up so that the lock portion projections 29*k* engages with the hook-shaped portions 83 of the cartridges 7. With the above, similar to the first exemplary embodiment, while the cartridge is included in the apparatus main body, even if an impact and vibration is applied due to being physically distributed, such as being transported, the cartridge can be prevented from jutting out towards the upstream side in the cartridge mounting direction.

With the configuration described above, an effect that is similar to that of the first exemplary embodiment can be obtained by the second exemplary embodiment. A similar effect is expected to be obtained with a relatively simpler configuration.

Other Exemplary Embodiments

In the exemplary embodiments described above, description of an electrophotographic color image forming apparatus adopting a contact developing system and a cartridge has been given as an example. However, the present disclosure can be applied to a monochrome electrophotographic image forming apparatus, a non-contact developing system, a development unit that can be mounted in the apparatus main body, and a developing agent unit including a developing agent.

Furthermore, in the exemplary embodiments described above, the cartridge includes a photosensitive drum and at least one process member. The process member includes, for example, a charge member, a development member, and a cleaning member. Accordingly, a cartridge is a charge member, a development member, and a cleaning member, and a photosensitive drum formed into a cartridge in an integrated manner, in which the cartridge is detachable with respect to the apparatus main body. Furthermore, a cartridge is at least one of a charge member, a development member, and a cleaning member being integrally formed into a cartridge together with a photosensitive drum, in which the cartridge is detachable with respect to the apparatus main body. Furthermore, a cartridge is a development member and a photosensitive drum integrally formed into a cartridge in which the cartridge is detachable with respect to the apparatus main body.

Other than the above, a toner cartridge that is a container filled with toner and that is a separate member with respect to the process member and the photosensitive drum described above is also included in the cartridge in which the toner cartridge is detachable with respect to the apparatus main body.

Furthermore, an image forming apparatus (an electrophotographic image forming apparatus) is an apparatus that forms an image on a recording medium using an electrophotographic image forming system. Furthermore, examples of the image forming apparatus include an electrophotographic copying machine, an electrophotographic printer (for example, a laser printer, an LED printer, and the like), a facsimile machine, and a word processor.

Note that other than the above, the description has been given while an optional direction has been referred to as up, and a direction opposite to the optional direction has been referred to as down. However, not limited to the above, the top and bottom may be inverted, and, in a similar manner, the left and right, the front and rear (the near side and the far side) in the exemplary embodiments described above may be inverted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-152147, filed Jul. 31, 2015, which is hereby incorporated by reference herein in its entirety.

What is claimed is:

1. An image forming apparatus, the image forming apparatus comprising:

a process cartridge including an engaged portion; and an apparatus main body to which the process cartridge is mountable, the apparatus main body including:

a guiding member configured to guide the process cartridge while the process cartridge is being mounted to the apparatus main body in a mounting direction, and configured to move up and down, together with the process cartridge, between a mounting position where the process cartridge is mountable and an image forming position, above the mounting position, where image forming is possible; and an engaging portion configured to engage with the engaged portion of the process cartridge so as to restrict a movement of the process cartridge in the mounting direction in a state that the guiding member is positioned at the image forming position, the engaging portion being configured to move up and down interlocking with the guiding member, wherein in a state that the guiding member is positioned at the mounting position, the engaging portion is spaced from the engaged portion of the process cartridge in a direction in which the guiding member moves up and down, so as not to engage with the engaged portion of the process cartridge, and wherein with a movement of the guiding member from the mounting position to the image forming position, the engaging portion approaches the engaged portion of the process cartridge, so that the engaging portion engages with the engaged portion of the process cartridge in the state that the guiding member is positioned at the image forming position.

2. The image forming apparatus according to claim 1, the guiding member moves up and down by interlocking with an opening and closing of a door that covers an opening for mounting of the process cartridge to the apparatus main body or detaching of the process cartridge from the apparatus main body.

3. The image forming apparatus according to claim 2, wherein the apparatus main body includes a guide portion disposed on the door, the guide portion being in communication with the guiding member in the mounting direction in a state that the door is open.

4. The image forming apparatus according to claim 1, wherein the apparatus main body includes a mounting portion disposed in the guiding member, the mounting portion being elastically compressible and movable up and down together with the guiding member, and wherein the process cartridge is mounted on the mounting portion when the process cartridge is mounted to the apparatus main body.

5. The image forming apparatus according to claim 4, wherein with the movement of the guiding member from the mounting position to the image forming position, a compression of the mounting portion between the process cartridge and the guiding member causes the engaging portion to approach the engaged portion of the process cartridge.

6. The image forming apparatus according to claim 1, wherein the apparatus main body includes a frame provided downstream of the process cartridge in the mounting direction, and wherein the engaging portion is provided on the frame so as to be movable up and down with respect to the frame interlocking with the guiding member.

7. The image forming apparatus according to claim 1, wherein the engaging portion is provided on the guiding member.

8. The image forming apparatus according to claim 4, wherein the process cartridge further includes a first abutment portion at an downstream end portion thereof in the mounting direction, and the apparatus main body further includes a frame provided downstream of the process cartridge in the mounting direction and including a second abutment portion against which the first abutment portion of the process cartridge abuts so as to position the process cartridge with respect to the apparatus main body in a direction crossing the mounting direction, and wherein with a movement of the process cartridge toward the frame in the mounting direction in a state the guiding member is positioned at the mounting position, the process cartridge moves obliquely upwards along a surface of the mounting portion so that the first abutment portion of the process cartridge abuts the second abutment portion, and so that the engaging portion is spaced from the engaged portion of the process cartridge in the direction in which the guiding member moves up and down.

9. The image forming apparatus according to claim 1, wherein the engaging portion of the apparatus main body and the engaged portion of the process cartridge each have a hook shape.

10. The image forming apparatus according to claim 1, wherein the mounting direction is paralleled to a longitudinal direction of the process cartridge.

* * * * *